United States Patent [19]

Kirkpatrick et al.

[11] 4,179,978

[45] Dec. 25, 1979

[54] CLAMP

[75] Inventors: Robert G. Kirkpatrick, Shelburne; Ronald R. Snyder, Milton, both of Vt.

[73] Assignee: General Electric Company, Burlington, Vt.

[21] Appl. No.: 863,986

[22] Filed: Dec. 23, 1977

[51] Int. Cl.[2] ..... F41D 7/04

[52] U.S. Cl. ..... 89/12

[58] Field of Search ..... 89/12, 160

[56] References Cited

U.S. PATENT DOCUMENTS

| | | | |
|---|---|---|---|
| 2,849,921 | 9/1958 | Otto | 89/12 |
| 2,872,847 | 2/1959 | Otto | 89/12 |
| 2,898,811 | 8/1959 | Helble | 89/12 |
| 3,101,027 | 8/1963 | Brogan | 89/12 |
| 3,897,714 | 8/1975 | Perrin et al. | 89/12 |
| 4,015,508 | 4/1977 | Blodgett et al. | 89/12 |

OTHER PUBLICATIONS

T. O. 11W1-12-4-34 of Apr. 15, 1965, pp. 2-8 and 2-9.

*Primary Examiner*—Stephen C. Bentley
*Attorney, Agent, or Firm*—Bailin L. Kuch

[57] ABSTRACT

This invention provides for a clamp system for the cluster of barrels of a Gatling type gun which locks each barrel in the cluster against rotation about its own longitudinal axis and which minimizes relative transverse movement of each of the barrels.

7 Claims, 4 Drawing Figures

CLAMP

The Government has rights in this invention pursuant to Contract F33657-73-C-0682 awarded by the Department of Air Force.

BACKGROUND OF THE INVENTION

1. Field of the Invention

This invention relates to means for retaining the barrels in a rotating battery gun, e.g. a Gatling type gun.

2. Prior Art

The use of clamps to retain each of the barrels of a Gatling type gun in a predetermined mutual relationship is conventional, and typified by the center barrel clamp assemblies and the muzzle clamp assemblies used on the M61 20 mm automatic guns, as shown in T.O. 11W1-12-4-34 of Apr. 15, 1965, pp. 2–8 and 2–9. In these systems, all six gun barrels are initially secured to the rotor against longitudinal movement by respective interrupted threads, and subsequently the clamp assemblies are slid onto the barrels as a group. These assemblies serve mainly to limit centrifugal whipping of the barrels. These assemblies are fixed against longitudinal movement to every other barrel by means of two bolted together plates straddling an integral ring on the respective barrel. A similar muzzle clamp is shown by D. R. Helble in U.S. Pat. No. 2,898,811 issued Aug. 11, 1959. Other clamps are shown by H. Otto in U.S. Pat. No. 2,849,921 issued Sept. 2, 1958 and U.S. Pat. No. 2,872,847 issued Feb. 10, 1959; by F. Blodgett, Jr. et al in U.S. Pat. No. 4,015,508 issued Apr. 5, 1977; D. Perrin et al in U.S. Pat. No. 3,897,714 issued Aug. 5, 1975; and R. E. Prince et al in Ser. No. 791,753, filed Apr. 28, 1977.

Conventionally, the gun is supported both at its housing by recoil adapters, and at a barrel clamp assembly by an antifriction bearing which permits rotation and limited reciprocation of the barrel cluster. Each barrel, in turn, as it fires, is eccentric to the longitudinal axis of the gun, which develops a turning moment, about the center of gravity of the gun, through the supports. This results in longitudinal distortion of each of the barrels. Further, the cluster of barrels is free to rotate within the clamp and to twist about the longitudinal axis of the gun, also resulting in a longitudinal distortion. These distortions result in an increase in the dispersion of the trajectories of the fired projectiles from the at-rest-boresight of the gun. Additionally, in reaction to the rotational forces about the individual barrel longitudinal axis developed by the projectile as it is fired through the length of the barrel, the barrel tends to unthread itself from the rotor.

SUMMARY OF THE INVENTION

It is an object of this invention to provide a barrel clamp system which minimizes distortion of the cluster of barrels, yet permits the convenient assembly and disassembly of each of the barrels from the cluster.

It is another object of this invention to provide a barrel clamp system which precludes the unthreading of the individual barrels from the rotor during firing.

It is yet another object to provide such a clamp system having a lubricant reservoir for the antifriction device.

A feature of this invention is the provision of a clamp system for the cluster of barrels of a Gatling type gun which locks each barrel in the cluster against rotation about its own longitudinal axis and which minimizes relative transverse movement of each of the barrels.

BRIEF DESCRIPTION OF THE DRAWING

These and other objects, features and advantages of the invention will be apparent from the following specification thereof taken in conjunction with the accompanying drawing in which.

DESCRIPTION OF THE INVENTION

Figure 1:
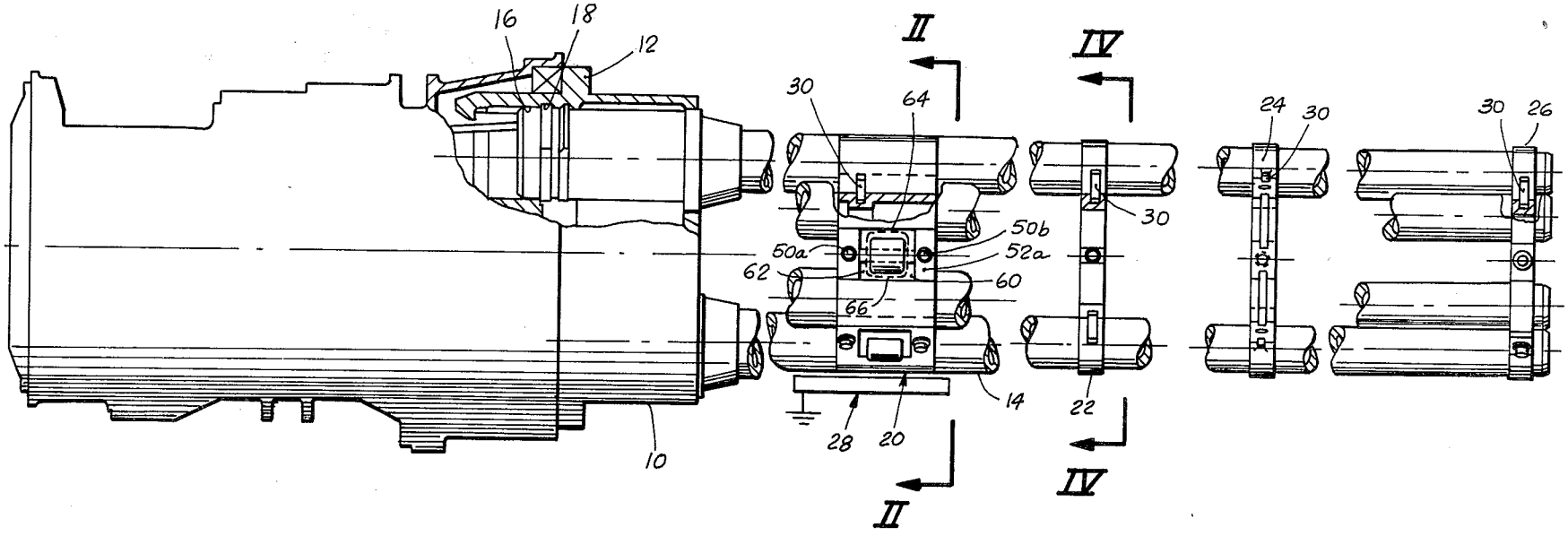
FIG. 1 is a partial side view of a Gatling type gun embodying this invention.
Figure 4:
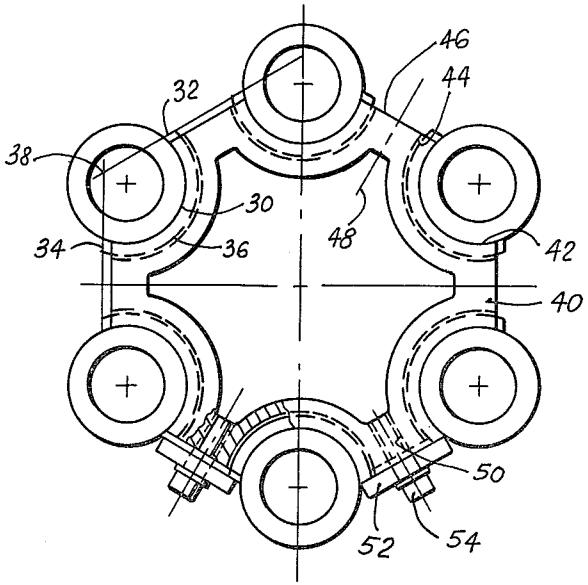
FIG. 4 is a view in cross-section taken along the plane IV—IV of FIG. 1.
Figure 3:
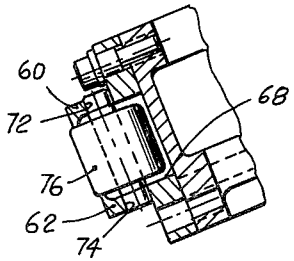
FIG. 3 is a view in cross-section taken along the plane III—III of FIG. 2.
Figure 2:
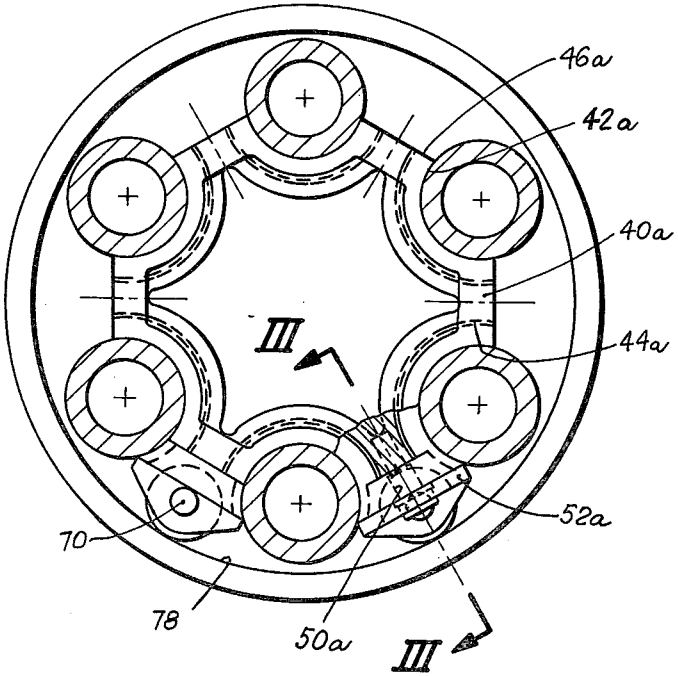
FIG. 2 is an end view in cross-section taken along the plane II—II of FIG. 1.

A Gatling type gun is shown in FIG. 1 having a stationary housing 10 in which is journaled a rotor 12. Six gun barrels 14 are respectively secured into bores 16 in the rotor by interrupted threads 18. A mid-barrel clamp assembly 20, a first additional clamp assembly 22, a second additional clamp assembly 24, and a muzzle clamp assembly 26 are provided along the length of the cluster. The gun is mounted by means of a pair of recoil adapters, not shown, fixed between the housing 10 and ground, and a forward gun support 28 and ground.

Each gun barrel 14 has four transverse lugs 30. Each lug 30 is substantially a sector having two flat sides 32 and 34 with an included angle of substantially 120°. While the arc side 36 of the lug has a center which is coincident with the longitudinal axis of the gun barrel, the vertex 38 of the sides may be displaced along a radius away from the longitudinal axis.

Each of the clamp assemblies 22, 24 and 26 includes a respective transverse ring 40 having six longitudinal partial substantially cylindrical surfaces 42, each nesting with a part of the substantially cylindrical surface of a respective gun barrel. Each surface 42 has a respective, transverse, arcuate slot 44 therein, to clear the arc surface 36 of a respective lug 30. A flat surface 46, extends longitudinally parallel to and between adjacent cylindrical surfaces 42 and is perpendicular to a radius 48 of the clamp ring 40. The surfaces 32 and 34 of the respective lugs are spaced above the surface 46 of the clamp ring. A radial threaded bore 50 is provided into each surface 46, and a flat plate 52 rests on the surfaces 32 and 34 of adjacent lugs and is clamped to the surface 46 by a headed bolt 54. Adjacent plates 52 clamp the therebetween lug 30 (or 32 or 34) against rotation about a longitudinal axis with respect to the clamp ring 40 and against radial or longitudinal displacement with respect to the clamp ring 40.

The midbarrel clamp assembly 20 has a similar structure with a ring **40*a* having six cylindrical surfaces 42*a*, each surface 42*a* having a transverse arcuate slot 44*a* therein, six flat surfaces 46*a*, each surface 46*a* having two longitudinally spaced apart, radial threaded bores 50*a* and 50*b*, and six plates 52*a*. Adjacent plates 52*a* clamp the therebetween lug 28 against rotation about a longitudinal axis with respect to the clamp ring 40*a* and against radial or longitudinal displacement with respect to the clamp ring 40. Each plate 52*a* includes a roller housing formed of two transversely extending walls 60 and 62, and two longitudinally extending walls 64 and 66, and a cutout 68 in the main plate. A roller pin or other shaft 70** is fixed into and between respective bores 72 and 74 in the transverse plates, and a roller 76 is journaled on the roller pin. The gap between the roller and the roller housing is filled with an appropriate grease, and serves as a reservoir with the roller acting as a wick. The rollers ride within a cylindrical surface 78 which forms part of the forward gun support 28. The rollers are free to rotate about their own axes and the axis of the barrel cluster, and to slide longitudinally.

It will be seen that these clamping assemblies permit each gun barrel to be assembled and disassembled individually from the barrel cluster.

The locking plates, which are supported by all of the barrels, bear on the side surfaces of the barrel lugs and preclude rotation of the respective barrel about its own longitudinal axis in reaction to the torque generated by the projectile traveling through the gun barrel.

The locking plates also minimize the twist of the entire cluster of barrels about the longitudinal axis of the cluster, and the wave like flexure of each barrel with respect to the longitudinal axis of the cluster.

What is claimed is:

1. A rotating battery gun comprising:
a housing,
a barrel cluster journaled for rotation about a longitudinal axis with respect to said housing and including
a rotor,
a plurality of gun barrels, each respectively secured to said rotor, and extending longitudinally therefrom, each of said gun barrels having a respective longitudinal axis and having a respective plurality of transversely extending surfaces; and
clamp means secured to each of said plurality of gun barrels and pressing against said respective plurality of transversely extending surfaces to preclude rotation of said surfaces about the respective longitudinal axis of the respecitve barrel.

2. A rotating battery gun comprising:
a housing,
a barrel cluster journaled for rotation about a longitudinal axis with respect to said housing and including
a rotor,
a plurality of gun barrels disposed in an annular row, each respectively secured to said rotor, and extending longitudinally therefrom, each of said gun barrels having a respective longitudinal axis and having a respective plurality of transversely extending surfaces; and
clamp means having a rigid annulus secured to each of said plurality of gun barrels and engaging said respective plurality of transversely extending surfaces to preclude rotation of said surfaces about the respective longitudinal axis of the respective barrel; and including
a rigid annulus having a like plurality of surfaces for abutting said respective plurality of transversely extending surfaces on each of said gun barrels.

3. A gun according to claim 2 wherein:
said annulus of said clamp means further includes
a plurality of centrifugally open cavities, each cavity having a roller journaled for rotation therein about a longitudinal axis which is parallel to said longitudinal axis of said barrel cluster, each roller having a portion of its peripheral surface extending centrifugally beyond its respective cavity.

4. A gun according to claim 3 wherein:
each of said rollers is journaled on a respective shaft secured to said annulus and spaced thereby from its respective cavity to provide a respective pocket for receiving and trapping a respective volume of grease for which the respective roller, when rotating, acts as a wick.

5. A gun according to claim 4 further including:
gun support means having an inside cylindrical surface against which bear said centrifugally extending peripheral surfaces of said rollers, said rollers rolling on said inside cylindrical surface about their respective longitudinal axes and said longitudinal axis of said barrel cluster and also sliding longitudinally thereon in response to recoil of said barrel cluster.

6. A rotating battery gun comprising:
a housing,
a barrel cluster journaled for rotation about a longitudinal axis with respect to said housing and including
a rotor,
a plurality of gun barrels, each respectively secured to said rotor, and extending longitudinally therefrom, each of said gun barrels having a respective longitudinal axis and having a respective plurality of transversely extending surfaces;
clamp means having a rigid annulus secured to each of said plurality of gun barrels and engaging said respective plurality of transversely extending surfaces to preclude rotation of said surfaces about the respective longitudinal axis of the respective barrel; and
each of said gun barrels having a plurality of longitudinally spaced apart sets of said transversely extending surfaces; and
a like plurality of longitudinally spaced apart clamp means, one for each set of said transversely extending surfaces.

7. A rotating battery gun comprising:
a housing,
a barrel cluster journaled for rotation about a longitudinal axis with respect to said housing and including
a rotar,
a plurality of gun barrels, each respectively secured to said rotor, and extending longitudinally therefrom, each of said gun barrels having a respective longitudinal axis and having a transversely extending lug having a respective plurality of transversely extending surfaces; and
clamp means having a rigid annulus secured to each of said plurality of gun barrels and pressing against said respective plurality of transversely extending surfaces to preclude rotation of said surfaces about the respective longitudinal axis of the respective barrel.

* * * * *